US011225859B2

(12) United States Patent
Warren et al.

(10) Patent No.: US 11,225,859 B2
(45) Date of Patent: Jan. 18, 2022

(54) OIL RECOVERY WITH INSULATING COMPOSITION

(71) Applicant: CONOCOPHILLIPS COMPANY, Houston, TX (US)

(72) Inventors: Logan Warren, Houston, TX (US); Siluni Wickramathilaka, Katy, TX (US); Thomas J. Wheeler, Houston, TX (US); David A. Brown, Katy, TX (US)

(73) Assignee: CONOCOPHILLIPS COMANY, Houston, TX (US)

( * ) Notice: Subject to any disclaimer, the term of this patent is extended or adjusted under 35 U.S.C. 154(b) by 0 days.

(21) Appl. No.: 14/565,961

(22) Filed: Dec. 10, 2014

(65) Prior Publication Data

US 2015/0159476 A1 Jun. 11, 2015

Related U.S. Application Data

(60) Provisional application No. 61/914,507, filed on Dec. 11, 2013.

(51) Int. Cl.
*E21B 43/24* (2006.01)

(52) U.S. Cl.
CPC ..... *E21B 43/2408* (2013.01)

(58) Field of Classification Search
CPC ..... E21B 43/24; C09K 8/592
See application file for complete search history.

(56) References Cited

U.S. PATENT DOCUMENTS 4,175,618 A * 11/1979 Wu ..... C09K 8/584 166/270.1
4,445,573 A * 5/1984 McCaleb ..... E21B 43/24 166/272.3
4,488,598 A * 12/1984 Duerksen ..... E21B 43/12 166/252.4
4,665,986 A * 5/1987 Sandiford ..... C09K 8/92 166/270
4,852,653 A * 8/1989 Borchardt ..... C09K 8/592 166/270.1
4,984,635 A * 1/1991 Cullick ..... C09K 8/94 166/261

(Continued)

OTHER PUBLICATIONS

Butler, R. (Jan. 1, 1997). Steam and Gas Push (SAGP). Petroleum Society of Canada. doi:10.2118/97-137.

(Continued)

*Primary Examiner* — William D Hutton, Jr.
*Assistant Examiner* — Avi T Skaist
(74) *Attorney, Agent, or Firm* — Boulware & Valoir

(57) ABSTRACT

Methods and systems produce petroleum products by insulating a thermal hydrocarbon recovery process from heat loss to surrounding areas of a formation utilizing an insulating composition including a non-gaseous phase component introduced into the reservoir that is different from water and insoluble in the hydrocarbons. The insulating composition may be disposed in the reservoir adjacent to where the heat loss is desired to be limited. In addition, the insulating composition may be disposed in a thief zone and may also be from an agent activated to form the composition at such desired locations by selecting activation dependent on at least one of temperature, time delay and oil saturation.

10 Claims, 2 Drawing Sheets

(56) References Cited

U.S. PATENT DOCUMENTS

| | | | | |
|---|---|---|---|---|
| 5,203,834 | A * | 4/1993 | Hutchins | C09K 8/50 166/270 |
| 5,407,009 | A | 4/1995 | Butler | |
| 5,607,016 | A | 3/1997 | Butler | |

OTHER PUBLICATIONS

Jiang, Q., Butler, R., & Yee, C. T. (Apr. 1, 2000). The Steam and Gas Push (Sag P)-2: Mechanism Analysis and Physical Model Testing. Petroleum Society of Canada. doi:10.2118/00-04-04.

Butler, R. M., Jiang, Q., & Yee, C. T. (Aug. 1, 2000). Steam and Gas Push (SAGP)-3;Recent Theoretical Developments and Laboratory Results. Petroleum Society of Canada, doi:10.2118/00-08-04.

Butler, R. M., Jiang, Q., & Yee, C. T. (Jan. 1, 2001). Steam and Gas Push (SAGP)-4;Recent Theoretical Developments and Laboratory Results Using Layered Models. Petroleum Society of Canada. doi:10.2118/01-01-06.

* cited by examiner

OIL RECOVERY WITH INSULATING COMPOSITION

CROSS-REFERENCE TO RELATED APPLICATIONS

This application is a non-provisional application which claims benefit under 35 USC § 119(e) to U.S. Provisional Application Ser. No. 61/914,507 filed Dec. 11, 2013, entitled "OIL RECOVERY WITH INSULATING COMPOSITION," which is incorporated herein in its entirety.

STATEMENT REGARDING FEDERALLY SPONSORED RESEARCH

None.

FIELD OF THE INVENTION

Embodiments of the invention relate to thermal hydrocarbon recovery from a reservoir insulated from energy losses to areas surrounding the reservoir.

BACKGROUND OF THE INVENTION

Bitumen recovery from oil sands presents technical and economic challenges due to high viscosity of the bitumen at reservoir conditions. Thermal recovery processes such as cyclic steam stimulation and steam assisted gravity drainage (SAGD) rely on injection of steam to heat the bitumen. The bitumen with reduced viscosity due to this heating then drains and is recovered.

Costs associated with energy requirements for generation of steam represent a significant portion of the overall operating expense. In addition, a typical SAGD operation may lose one third of the energy injected to overburden rock, underlying rock and/or thief zones, such as surrounding water and/or gas layers. Inefficiency due to such thermal losses limits economic returns.

Various approaches attempt to limit the thermal losses, but can present problems. For example, injection of non-condensable gases may form an insulating layer to the overburden. The gases fail to mitigate underlying thermal losses and may accumulate impairing heat transfer from the steam to the bitumen, decreasing temperature of the drainage interface due to partial pressure impact, and decreasing effective permeability to oil as a result of increased gas saturation.

Therefore, a need exists for methods and systems for recovering hydrocarbons from oil sands that are energy efficient.

BRIEF SUMMARY OF THE DISCLOSURE

In one embodiment, a method of recovering hydrocarbons includes disposing an insulating composition within the reservoir adjacent one of an overburden stratum and an underlying stratum. The insulating composition includes a non-gaseous phase component introduced into the reservoir that is different from water and insoluble in the hydrocarbons. The method further includes injecting steam into the reservoir with thermal diffusivity from the steam limited by the insulating layer and producing hydrocarbons heated by the steam.

According to one embodiment, a method of recovering hydrocarbons includes introducing an agent underground activated by at least one of temperature, time delay and oil saturation to form an insulating composition. Injecting steam into the reservoir heats the hydrocarbons while thermal diffusivity from the steam is limited by the insulating composition. Producing then recovers the hydrocarbons.

For one embodiment, a system for recovering hydrocarbons includes an insulating composition within the reservoir adjacent one of an overburden stratum and an underlying stratum. The insulating composition includes a non-gaseous phase component introduced into the reservoir that is different from water and insoluble in the hydrocarbons. In addition, the system includes a steam injection well for supplying steam into the reservoir with thermal diffusivity from the steam limited by the insulating composition and a production well for recovery of the hydrocarbons heated by the steam.

BRIEF DESCRIPTION OF THE DRAWINGS

A more complete understanding of the present invention and benefits thereof may be acquired by referring to the following description taken in conjunction with the accompanying drawings.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Embodiments of the invention relate to insulating a thermal hydrocarbon recovery process from heat loss to surrounding areas of a formation utilizing an insulating composition including a non-gaseous phase component introduced into the reservoir that is different from water and insoluble in the hydrocarbons. The insulating composition may be disposed in the reservoir adjacent to where the heat loss is desired to be limited. In addition, the insulating composition may be disposed in a thief zone and may also be from an agent activated to form the composition at such desired locations by selecting activation dependent on at least one of temperature, time delay and oil saturation.

Figure 1:
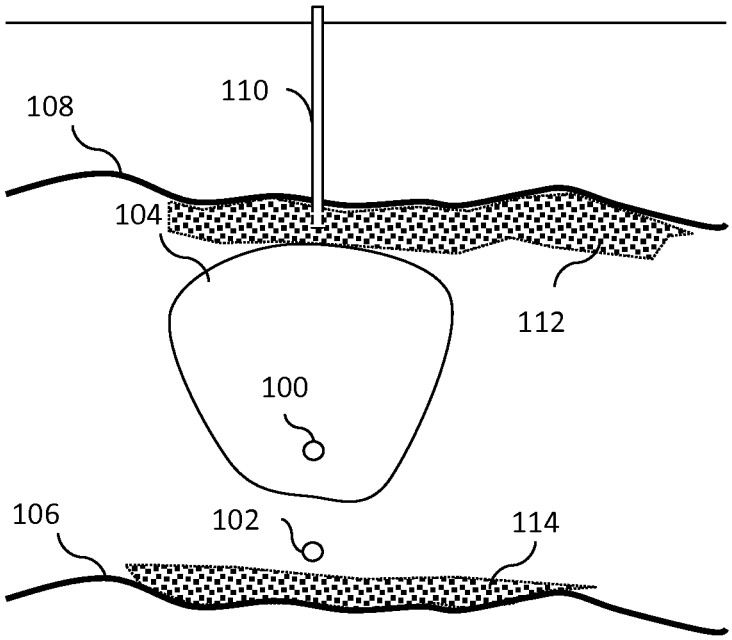
FIG. 1 is a schematic of a thermal recovery system with layers of an insulating composition adjacent an overburden stratum and underlying stratum to limit thermal losses, according to one embodiment of the invention.

FIG. 1 illustrates a system for recovering hydrocarbons that includes at least one production well 102 and at least one injection well 100, which couples to a steam generator. In an exemplary embodiment, the injection well 100 and the production well 102 provide a well pair for a steam assisted gravity drainage (SAGD) operation. Various other thermal oil recovery operations including cyclic steam stimulation, solvent aided SAGD and steam drive may also employ processes described herein.

In operation, a steam chamber 104 develops as steam is introduced into the formation through the injection well 100 and a resulting petroleum fluid is recovered from the production well 102. The steam contacts the hydrocarbons such that heat transfers upon condensation making the hydrocarbons mobile and enabling gravity drainage thereof. The petroleum fluid of steam condensate and the hydrocarbons migrate through the formation due to gravity and is gathered at the production well 102 for recovery to surface.

The injection well 100 extends in a horizontal direction above and parallel to the production well 102 that are both within a reservoir containing the hydrocarbons for recovery. In some embodiments, an underground formation includes the reservoir that is bounded by an underlying stratum 106 and an overburden stratum 108, which may both be less permeable than the reservoir and may obstruct flow of, or be impermeable to, fluids such as the hydrocarbons or the steam. As the steam chamber 104 grows, any heat transfer to the underlying stratum 106 or overburden stratum 108 represents inefficient thermal loss since the heat is desired to be transferred only to the hydrocarbons.

In some embodiments, the underlying stratum 106 and/or overburden stratum 108 may define thief zones in the formation. Examples of the thief zones include top water, bottom water, top gas, and top gas-water zones. The thief zones also remain distinct from the reservoir bounded thereby.

For some embodiments, an auxiliary well 110 extends to below the overburden stratum 108 with openings into the reservoir proximate an interface of the reservoir with the overburden stratum 108. The auxiliary well 110 may exist from prior uses, such as delineation wells, or is a new borehole and may be a vertical or horizontal configuration. The auxiliary well 110 may also be located some lateral distance away from the top of the steam chamber 104 and may not be in vertical alignment with the injection well 100 and the production well 102 even though shown in such exemplary alignment. By supplying an insulating composition or an agent to generate the insulating composition through the auxiliary well 110, an upper layer 112 of the insulating composition forms at a top of the steam chamber 104 or between the steam chamber 104 and the overburden stratum 108 within the reservoir. The upper layer 112 may fill part of the steam chamber 104 redefining an upper boundary thereof. The upper layer 112 may also contact the overburden stratum 108 and have an average thickness of 0.5 to 5 meters or 1 to 10 meters, for example.

Similar to the upper layer 112, a lower layer 114 may be disposed within the reservoir above and proximate to the underlying stratum 106 to also limit thermal diffusivity from the steam injected to outside of the reservoir. Embodiments may employ one or both of the upper layer 112 and the lower layer 114 depending on particular formation and thermal conditions. The lower layer 114 may contact the underlying stratum 106 and have an average thickness of 0.5 to 5 meters or 1 to 10 meters, for example. Further, the upper layer 112 and the lower layer 114 may contain like or different chemical makeup of the insulating composition.

Use of wells, such as the auxiliary well 110, disposed within target locations in the formation illustrates one approach for placement of the upper layer 112 and/or the lower layer 114. However, embodiments may utilize the injection well 100 and/or the production well 102 for supplying the agent or the composition that forms the upper layer 112 and/or the lower layer 114. Injection of the agent or the composition through the injection well 100 may occur by co-injecting with the steam or in slugs during periods of time when steam injection is discontinued. The agent or the composition used to form the upper layer 112 may rise with the steam until reaching the overburden stratum 108 if introduced through the injection well 100 and thus have a density less than the steam. Regarding the lower layer 114, the agent or the composition may settle to the underlying stratum 106 due to having a density greater than the hydrocarbons and water mixture being produced.

The insulating composition providing the upper layer 112 and/or the lower layer 114 may form underground upon activating the agent or be generated on surface, such as by use of the agent prior to supplying the insulating composition underground. The agent thereby transforms to have different physical and/or chemical properties upon forming the insulating composition. For some embodiments, the insulating composition lacks solubility in the hydrocarbons such that the insulating composition remains distinct and is thereby not relied on to facilitate recovery due to solvation.

In some embodiments, at least one of foam, an aerosol, a hydrosol, an emulsion and a colloidal dispersion may provide the insulating composition. For example, the insulating composition may include a gaseous and liquid fluid with trapped gas in the fluid limiting thermal conductivity of the upper layer 112 and/or the lower layer 114. The insulating composition may provide a thermal conductivity less than the hydrocarbons, water and combinations thereof.

For some embodiments, injecting a gas with the agent thus facilitates generation of the insulating composition. Generating the fluid based on the agent with the steam alone may collapse gas and liquid phases of the insulating composition if the steam condenses. Suitable gases for co-injection with the agent include air, oxygen, hydrogen, nitrogen, methane, carbon dioxide, carbon monoxide, hydrogen sulfide, propane, butane, natural gas, and flue gas.

The agent referenced herein may include active polymers, polymer reactants and/or thermally and chemically stable, non-ionic, anionic, cationic and amphoteric/zwitterionic surfactants, such as alkyl benzene sulfonates, aromatic sulfonates, olefin sulfonates, alkyl aryl sulfonates and alkoxy sulfates. Other examples of the agents include alkaline metal carbonates, bicarbonates and hydroxides, such as sodium carbonate, sodium bicarbonate, sodium hydroxide, potassium carbonate, potassium bicarbonate, potassium hydroxide, magnesium carbonate and calcium carbonate.

For some embodiments, the agents activate to form the insulating composition at desired locations by selecting activation dependent on at least one of temperature, time delay and oil saturation. This selective activation of the agent may help ensure that the insulating composition does not block thermal and/or fluid transfer to areas of the reservoir where heating is still desired. The agent in some embodiments may thus travel from the injection well 100 to either the upper layer 112 or the lower layer 114 prior to activating without creating issues from premature setting around the injection well 100 or in the steam chamber 104 if the insulating composition chosen becomes stable once set and does not tend to migrate through the reservoir.

With respect to temperature based activation, the agent may initiate, react or otherwise activate by either an increase or decrease in temperature depending on how applied as explained further herein. The interface of the reservoir with the overburden stratum 108 often remains cooler than the interface of the steam and oil drainage areas along lateral portions of the steam chamber 104. This difference enables targeting formation of the upper layer 112 where desired.

In some embodiments, the agent remains inactive at temperatures above a threshold, such as 200° C., and is activated by temperatures below the threshold. Various known thermo-responsive polymers exhibit such behaviors. The agent may also activate upon a 50° C. to 100° C. temperature reduction from an initial temperature at injection. In the steam chamber 104, temperatures reach 240° C.

such that the agent may stay inactive upon injection into the injection well 100 and while migrating through the steam chamber 104 until reaching un upper boundary of the steam chamber 104 where temperatures fall to below 200° C. or even below 100° C. within a few meters of the steam chamber 104.

Regarding time delay based activation, selecting a time duration at which the agent is activated may include selecting or controlling reaction kinetics through known approaches. The duration for the agent to travel from the auxiliary well 110 or the injection well 100 to along where desired in the formation depends on factors such as distance, formation permeability and viscosity of the agent. Calculations using these factors can thus determine the duration wanted. For example, the agent may be selected to activate only after sufficient time (e.g., at least one hour, at least one day, or at least one week) has passed for the agent to travel from the injection well 100 through the steam chamber 104 and reach the overburden stratum 108 where the upper layer 112 is to be formed.

In respect to oil saturation based activation, relative permeability modifiers, such as various commercial polymers used in other reservoir flow control applications, change fluid behavior in oil relative to other media and therefore may be suitable as the agent. The oil saturation within the steam chamber 104 falls to about 20 percent due to the recovery but may be at about residual oil saturation or at least 95 percent in the reservoir along an interface with the overburden stratum 108, for example. The agent thus may activate to form the insulating composition as oil saturation increases after migration of the agent through the steam chamber 104. In some embodiments, the agent forms the insulating composition due to stability when within oil saturations of at least 50 percent while unstable in lower oil saturations.

Figure 2:
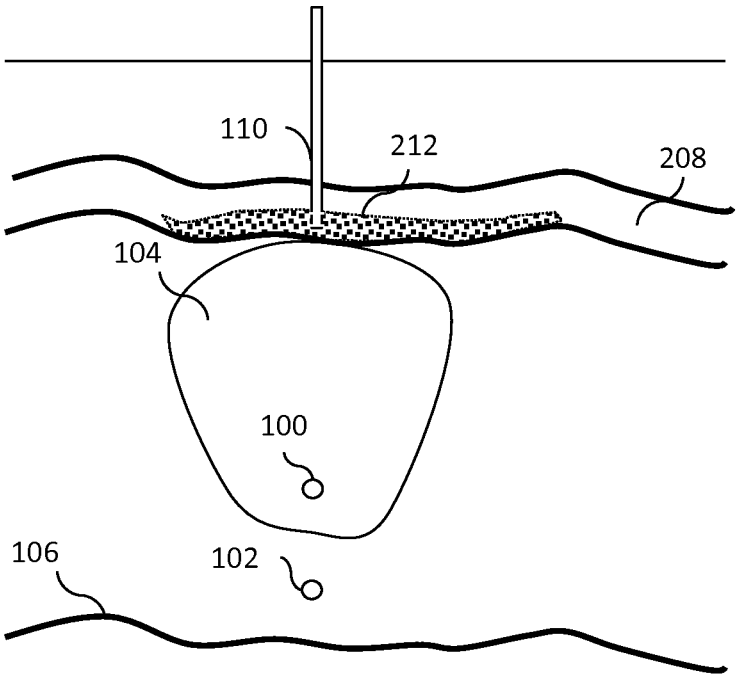
FIG. 2 is a schematic of the thermal recovery system with the insulating composition in a thief zone and selected to activate at a boundary of the thief zone and a reservoir, according to one embodiment of the invention.

FIG. 2 shows a thermal recovery system with an interface layer 212 of the insulating composition in a thief zone 208. Like reference numbers correspond with features described herein already with respect to FIG. 1. Selection of the agent supplied through the auxiliary well 110 into the thief zone 208 may result in activation at a boundary of the thief zone and the reservoir or the steam chamber 104.

For example, a temperature based activation of the agent may result in forming the insulating composition as the temperature increases away from the auxiliary well 110 and along the thief zone 208 where heat is being transferred from the steam chamber 104. In some embodiments, BrightWater® particles from Nalco Company may be employed for such temperature based activation. For example, the agent may activate at temperatures greater than 50° C. or greater than 90° C. to form the insulating composition while remaining inactive at lower temperatures within the thief zone 208 to ensure desired placement and setting of the interface layer 212.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

The invention claimed is:

1. A method of recovering hydrocarbons from a reservoir, comprising:

a) injecting steam into a horizontal injection well over a parallel horizontal production well in a hydrocarbon containing reservoir to form a steam chamber;

b) injecting an agent comprising a polymer plus a gas into said injection well and thereby into said steam chamber;

c) activating said agent by temperature reduction from an initial temperature at injection into said steam chamber to a cooler temperature at an overburden stratum thereby forming a composition from said agent adjacent said overburden stratum;

d) injecting steam into said steam chamber, wherein said composition limits diffusion of said steam; and e) producing said hydrocarbon at said production well.

2. The method of claim 1, wherein said agent is injected during a period of time when steam injection is discontinued.

3. The method of claim 1, wherein said agent is co-injected with steam.

4. The method of claim 1, wherein said agent has a density less than steam and said composition forms at said overburden stratum.

5. The method of claim 1, wherein said agent has a density greater than a hydrocarbon and water mixture being produced and said composition forms at said underlying stratum.

6. The method of claim 1, wherein said agent activates upon a 50-100° C. temperature reduction from said initial temperature at injection.

7. The method of claim 1, wherein said polymer is a thermoresponsive polymer.

8. The method of claim 1, wherein said composition is a foam.

9. The method of claim 1, wherein the gas is a non-condensable gas.

10. A method of recovering hydrocarbons from a reservoir, comprising:

a) injecting steam into a horizontal injection well over a parallel horizontal production well in a hydrocarbon containing reservoir to form a steam chamber;

b) injecting an agent comprising a thermoresponsive polymer plus a noncondensable gas into said injection well and thereby into said steam chamber;

c) activating said agent by temperature reduction from an initial temperature at injection into said steam chamber to a cooler temperature at an overburden stratum thereby forming a composition from said agent adjacent said overburden stratum;

d) injecting steam into said steam chamber, wherein said composition limits diffusion of said steam; and e) producing said hydrocarbon at said production well.

* * * * *